United States Patent [19]

Stoody

[11] Patent Number: 4,735,346

[45] Date of Patent: Apr. 5, 1988

[54] CHILD RESISTANT VALVING NOZZLE

[76] Inventor: William R. Stoody, 8659 Summerdale Rd., San Diego, Calif. 92126

[21] Appl. No.: 770,565

[22] Filed: Aug. 29, 1985

[51] Int. Cl.[4] ..... B67B 5/00

[52] U.S. Cl. ..... 222/153; 222/402.11; 239/479

[58] Field of Search ..... 222/153, 542, 402.11, 222/402.12, 402.17, 402.1, 549, 553, 519, 548, 556; 239/337, 478, 477, 479

[56] References Cited

U.S. PATENT DOCUMENTS

| | | | |
|---|---|---|---|
| 2,831,608 | 4/1958 | Soffer et al. | 222/402.11 |
| 2,997,243 | 8/1961 | Kolb | 222/402.17 |
| 3,083,872 | 4/1963 | Meshberg | 222/402.17 |
| 3,169,672 | 2/1965 | Soffer et al. | 222/402.11 |
| 3,180,536 | 4/1965 | Meshberg | 222/402.11 |
| 3,184,116 | 5/1965 | Huling | 222/402.11 |
| 3,261,513 | 7/1966 | Moran | 222/519 |
| 3,278,093 | 10/1966 | Lehmann | 222/402.17 |
| 3,471,066 | 10/1969 | Micallef | 222/519 |
| 3,703,994 | 11/1972 | Nigro | 222/402.17 |
| 3,721,423 | 3/1973 | Shay | 222/402.11 |
| 3,768,475 | 10/1973 | Osborne | 222/402.11 |
| 3,848,778 | 11/1974 | Meshberg | 222/402.11 |
| 4,516,695 | 5/1985 | Garneau | 222/153 |
| 4,566,611 | 1/1986 | Sukoff | 222/153 |

*Primary Examiner*—Joseph J. Rolla
*Assistant Examiner*—Kenneth Noland

[57] ABSTRACT

A valve actuator that establishes a secondary valve which may be positioned to prevent unintentional dispensation of fluid product. The actuator includes a dispensing head, for example, mounted on a hollow plunger, rotatably positionable relative thereto and valvingly cooperative therewith to selectively open (facilitate) or close (block) discharge passage of fluid product. The dispensing head preferably includes a depressible latching pawl that is reciprocatively biased to retainingly engage the plunger when the dispensing head is rotated to the close valving position and hold the dispensing head from further positional rotation until the pawl is depressingly disengaged.

18 Claims, 4 Drawing Sheets

CHILD RESISTANT VALVING NOZZLE

RELATED APPLICATIONS

The applicant's related co-pending applications is: Ser. No. 612,131 filed May 21, 1984, now U.S. Pat. No. 4,595,127.

BACKGROUND OF THE INVENTION

The present invention discloses an improved dispensing head, usable on aerosol and pump type dispensers. The invention is unique in that the dispensing head is adapted to provide a secondary valving actuator means, that is in addition to the dispenser primary valve means, which is valvingly positionable to a close position to prevent discharge regardless of the valving state of the dispenser valve. And the invention, in its preferred embodiment, is further enhanced by a latching means capable of holding the dispensing head in the close valving position unitl it is manipulated to release its hold.

Essential features of aerosol and pump type dispensers are simplicity and convenience. They must be substantially more convenient than other alternatives and they must be simple for adults to understand and operate. For these reasons, the dispensers are particularly hazardous to young children, because dispensers containing harmful fluid are often stored in conveniently located places accessible to young children, and the fluid is easily discharged.

While it is realized that the dispensers cannot be completely child proof, the present invention provides for much safer dispensers that are convenient and still simple enough for adults to understand and operate.

Heretofore a solution to the problem has involved use of a pushbutton/nozzle combination having a keying tab requiring indexing alighment with a slot, provided in a stationary sleeve fastened onto an aerosol valve, before the pushbutton can be depressed for product discharge. To facilitate the alignment, the pushbutton has a sight hole for viewing and determining the alignment position. This solution has not proven satisfatory due to the difficulty adults have in understanding and operating th pushbutton. As a result, these nozzles do not meet the convenience and simplicity requirements, thus, they are not used.

There remains, therefore, a requirement and a need for a convenient, simple to use actuator, for dispensers, that is child resistant. This need and requirement can best be fulfilled by the invention hereof.

SUMMARY OF THE INVENTION

The present invention discloses a valve actuator having a dispensing head that establishes a secondary valve that may be positioned to impede unintentional dispensation of fluid product.

It is an object of this invention to provide an improved child resistant actuator means having a rotatably positionable dispensing head, that has at least one discharge oriface, mounted on a hollow plunger or the like. The dispensing head and plunger being suitably adapted to establish a fluid flow line, and to facilitate incorporation with a substantially conventional aerosol valve (or pump means) for fluid flow from the interior of a product container to the exterior of the actuator means via the aerosol valve, hollow plunger and discharge oriface.

Another object is to provide a plunger having at least one aperture passing through a wall thereof providing flow through communiction between the plunger hollow and dispensing head.

Another object is to provide a dispensing head being valvingly rotatable, relative to said plunger, to at least one open position whereat the oriface and aperture are aligned providing a flow through passageway from said hollow to the exterior of said actuator means, and the dispensing head being further rotatable relative to said plunger to a close, off, valving position whereat the oriface and aperture are out of alignment and said passageway is sealingly blocked off obstructing flow through communication between said hollow and the exterior of said actuator means.

Still another object is to provide a dispensing head having an attached pawl being reciprocatively biased to retainingly engage the plunger and thereby impede relative rotation of the dispensing head and plunger when the dispensing head is in said close off position, the pawl being depressibly disengageable to allow rotation of said dispensing head to said open position.

Other objects, advantages and novel features of the invention will be apparent as it is better understood from the following description, which, taken in connection with the accompanying drawings, disclose preferred embodiments thereof.

DETAILED DESCRIPTION

Figure 1:
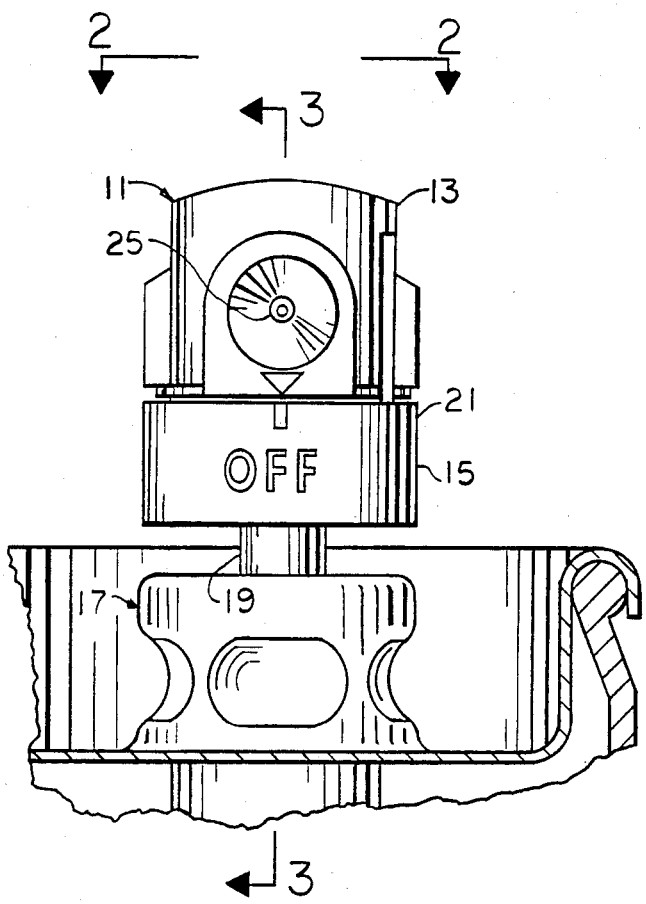
FIG. 1 is a frontal view of the actuator according to the invention, shown in an off, or closed, valving position, and mounted on a primary valve with which the present invntion may be utilized.

In the preferred embodiment, relating to an actuator means for operation of a primary valve mounted on a container of fluid product, there is shown in FIG. 1 a child resistant secondary valving nozzle, commonly termed pushbutton, designated 11, having a rotatably positonable dispensing head 13 axially mounted and valvingly cooperative with a hollow plunger 15, accordingly described in relation to aerosol type dispensers having a substantially conventional valve 17, disposed on a product container, and usually including a reciprocatively depressible valve stem 19 for expelling product from the container. As will be seen, however, the invention is not limited to aerosol valve actuator nozzles, but is likewise readily available for pump type dispenser actuation nozzles. In such case dispensing head 13 will be axially mounted on the pump plunger, that corresponds to plunger 15, in the same manner so as to achieve the same purpose as described in reference to an aerosol valve actuator as hereinafter described.

Dispensing head 13 and plunger 15 each have a substantially circular cross section, as viewed from the top, for ease of assembly and operation. The plunger can be made from any suitable material, preferably plastic; and the dispensing head is made from a plastic material having fairly good spring characteristics or other suitable material.

Figure 2:
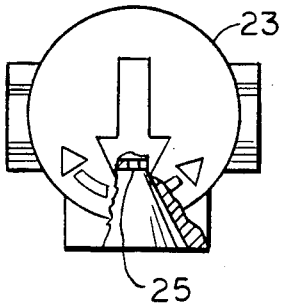
FIG. 2 is a top plan view of the actuator, taken in the direction of line 2—2 of FIG. 1.

Plunger 15 has an upstanding collar 21 which may have SPRAY, STREAM, OFF, or other suitable indicia imprinted in appropriate locations on the exterior sides thereof, and upwardly extending lines associated therewith. And, dispensing head 13 may have a downwardly pointing arrow to aid the user in selecting desired positioning of said dispensing head. An upper wall 23, seen in FIG. 2, of the dispensing head may have an arrow applied thereto indicating the location of a discharge oriface 25, together with curved arrows showing the direction in which the dispensing head may be rotated.

Figure 3:
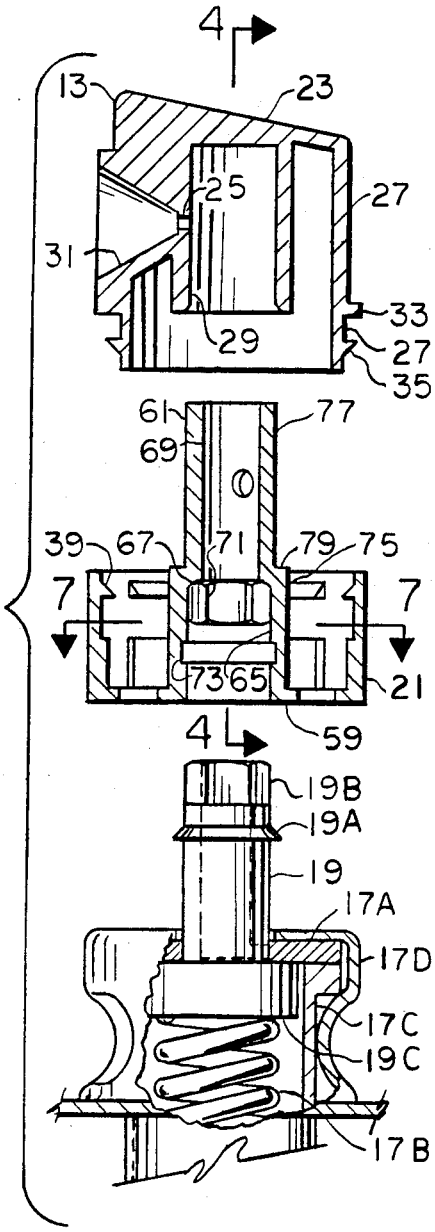
FIG. 3 is an expanded cross sectional side view of the actuator taken in the direction of line 3—3 of FIG. 1.

Dispensing head 13, as shown in FIG. 3, includes an outer cylindrical wall 27, having an open lower end, depending from its upper wall 23, as well as inner cylindrical sleeve 29 also having an open lower end, and likewise depending from wall 23. Discharge oriface 25 extends through this sleeve and is surrounded by a conical wall 31 extending between wall 27 and sleeve 29.

Externally at the open lower end of wall 27 a stiffening flange 33 substantially encircles said end and spaced below said flange is an annular retaining lip 35, the space therebetween providing an annual groove 37. The retaining lip and groove are adapted for mating engagement with a corresponding retaining lip 39 formed around the inner surface of collar 21 adjacent to its upper end. Said retaining lips are adapted to captivatingly hold said dispensing head and said plunger together unitarily and allow free rotation relative thereto.

Figure 4:
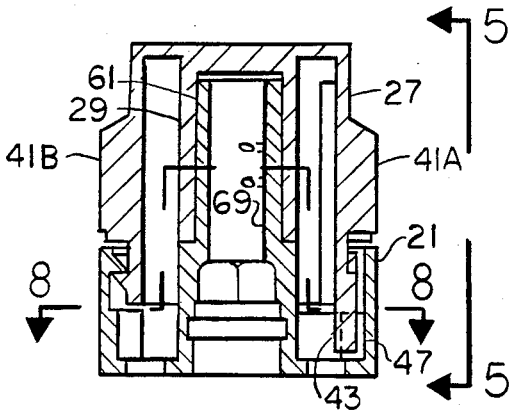
FIG. 4 is a cross sectional view taken in the direction of line 4—4 of FIG. 3 showing the actuator unitarily joined.
Figure 5:
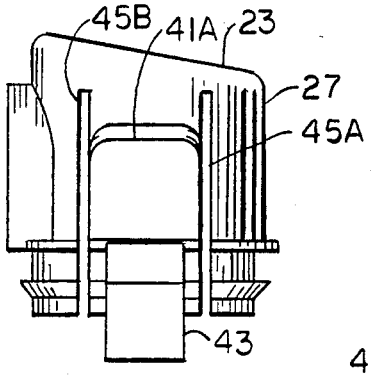
FIG. 5 is a side view, taken along line 5—5 of FIG. 4, to best illustrate features in the direction thereof, a lower component portion is omitted for clarity.

Along opposite exterior surfaces of wall 27 are thick wall sections forming outwardly raised pads 41A and 41B, best sen in FIG. 4, which are located perpendicular to the axis of said discharge oriface. Spaced beneath pad 41A, and depending from wall 27, is an outwardly thickened appendage, herein after referred to as latch means or pawl 43, that extends downwardly below the lower open end of said wall. Also, there are two slits 45A and 45B, see FIG. 5, which extend upwardly along opposite sides of pad 41A from the lower open end of wall 27 and terminate beneath upper wall 23.

Figure 6:
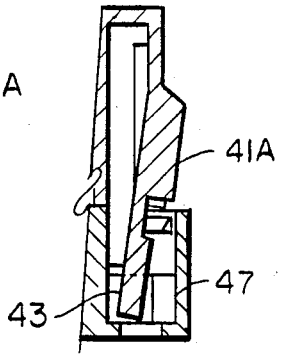
FIG. 6 is a partial side view similar to FIG. 4 showing a feature therof in a displaced position.

Since said dispensing head is made from a material having fairly good spring characterisitics, said slits enable pivotable rciprocative movement of pawl 43 in an inwardly direction as seen in FIG. 6 from a naturally biased position for snap-in-place engagement with catch means 47 described below. Said pads provide readily identifiable locations for user to grip the dispensing head, between a thumb and forefinger, for rotational positioning and at the same time squeeze the dispensing head sides depressing pawl 43 thereby disengaging said pawl from said catch means.

Figure 7:
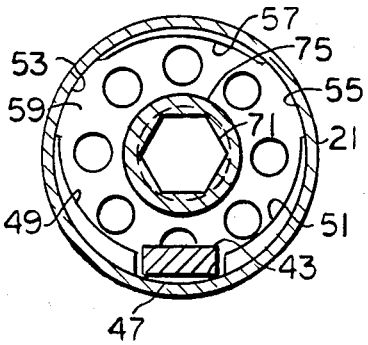
FIG. 7 is a cross sctional view taken along line 7—7 of FIG. 3, for clarification of features in the direction thereof.

In viewing FIG. 7 it can be seen that a vertical groove 47 is formed between two gradually thickening inside wall surfaces 49 and 51 of collar 21, and two shallow vertical grooves 53 and 55 ar equally spaced therefrom. Grooves 53 and 55 are formed by surfaces 49 and 51 respectively and a third gradually thickening wall surface 57 which at its thickest point is diametrically opposite groove 47. Said grooves are adapted to accommodate said pawl, and surfaces 49, 51 and 57 are essentially cam surfaces against which said pawl bearingly travels during rotation of the dispensing head with respect to plunger 15.

Grooves 53 and 55 establish sensing detents to facilitate positioning in an appropriate discharge position, correspondingly the increase in surface 57 is only the amount needed to facilitate grooves 53 and 55. Howver, surfaces 49 and 51 substantially increase in thickness providing at their thickest points step down sides which form a catch means or groove 47 within which pawl 43 is adapted to cooperatively engage. Plunger 21 retaining lip may be interrupted where needed at said groove locations to facilitate forming.

In FIG. 3 it is seen that collar 21 is joined to an upstanding centrally located hollow cylindrical stem 61 by a conveniently apertured wall 59. Stem 61 is shown, as a matter of choice, having an open upper end which may alternatively be closed. The lower inner portion of stem 61 is adapted for snug-fit axial mounting on primary valve stem 19 for cooperative axial reciprocative and rotational movement therewith. The hollow of stem 61 is established by a bore 65 that is inwardly stepped, providing annular shoulder 67, to a smaller diameter upper boree 69. Immediately beneath said shoulder, bore 65 has hexagonal configured walls designated 71, and spaced slightly below the hexagonal walls bore 65 additionally has an annular groove 73.

Shoulder 67 provides a sealing seat against which the end of said valve stem sealingly bears, when the pushbutton is depressed, to prevent product seepage threat. The hexagonal wall portion of bore 65 is adapted to keyingly fit on a correspondingly shaped upper end portion 19B of the valve stem to prevent rotation of the plunger relative to the valve stem. And, groove 73 is adapted to correspond with an annular retention lip 19A, provided on the valve stem, for snap-fit capturing engagement therewith. Said groove is slightly elongated, as seen in longitudinal cross section, so as to assure that the valve stem can fully seat against shoulder 67.

In addition to its normal purpose the aerosol valve is utilized, for the purpose of the present invntion, as a slip-clutch when the pushbutton is mounted thereon. Generally in aerosol valves the valve stem base flange 19C under spring 17B pressure, seats against a rubber gasket 17A disposed in a body 17C and retained by a valve cup 17D. Thus, they provide a natural slip-clutch that frictionally resists rotation. This is a particularly important feature since it limits the torsional force that can be applied against the pawl, protecting the pawl from being twisted off, and it provides enough resistance to hold the plunger from rotating with respect to the dispensing head, when the pawl is disengaged, for selection of a valving position.

The outside surface of stem 61 steps down in size from a lower first diameter 75 to an upper second diameter 77 providing a shoulder 79 against which the lower end of sleeve 29 sealingly bears whenever the pushbutton is in a depressed state. Second diameter 77 and the hollow of sleeve 29 are relatively sized for snug-fit sealing engagement therebetween.

Figure 8:
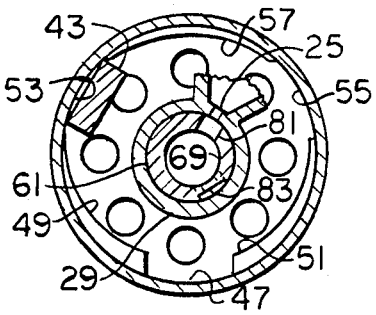
FIG. 8, FIG. 10 and FIG. 12 are similar cross sectional views taken substantially along line 8—8 of FIG. 4, showing two viewing planes, and illustrating alternative valving positions of the actuator.
Figure 9:
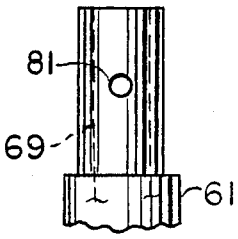
FIG. 9 and FIG. 11 are similar side views provided to best illustrate discharge features of the actuator.

In FIGS. 8 and 9, it can be seen that stem 61 second diameter has a side aperture 81, that extends from bore 69 through one wall providing a fluid flow passage from bore 69 to the stem outer diameter 77. The aperture is radially located approximately 150 degrees counterclockwise from the middle of groove 47 and it is axially located to be in flow through valving alignment with oriface 25 for dispensing product in stream form (or foam) when pawl 43 is positionally located in sensing detent groovee 53.

Figure 10:
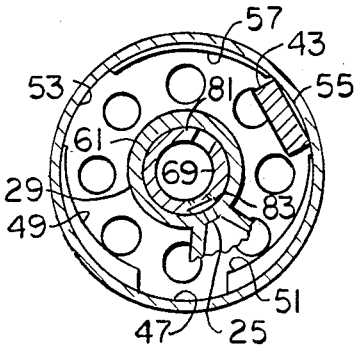
Figure 11:
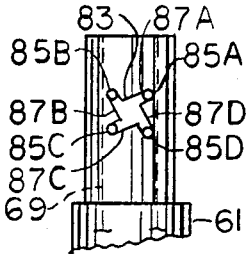

As further seen in FIGS. 10 and 11, and outwardly open circular depression 83 is formed in second diameter 77 of stem 61 at a radial location approximately 120 degrees clockwise from aperture 81 at an axial location to be in flow through alignment with oriface 25 for dispensing product in spray mist form when pawl 43 is positionally located in sensing detent groove 55.

Radially spaced outward from the center of depression 83 are four separate, equally spaced apertures 85A, 85B, 85C, 85D which respectively pass through a wall of stem 61 and open into bore 69. The four apertures open in to four grooves 87A, 87B, 87C, 87D, respectively, that extend along the curved external surface of said stem second diameter and open tangentailly into depression 83, at opposite sides thereof, establishing depression 83 as a fluid product mechanical breakup swirl chamber when the discharge oriface is aligned therewith. The swirl chamber is adapted to cause fluid product to break up into a spray mist upon dispensing departure from the discharge orifice.

It should be realized that there are many commonly known alternative and substantially equal forms of swirl chambers. It should be further realized that either the swirl chamber or aperture 81 can be eliminated to provide a valve actuator having a single dispensing function, and in such case, stops (not shown) can readily be provided in plunger 15 to reduce rotational travel between the open and close valving positions.

Figure 12:
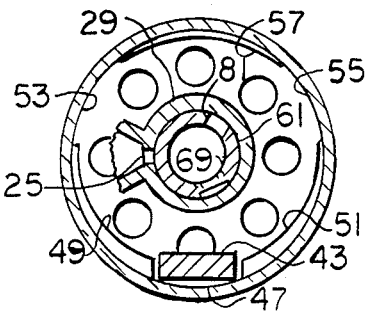

In the close valving position, see FIG. 12, whereas pawl 43 is positionally located in groovee 47, the plunger stem second diameter 77 surface sealingly obstructs oriface 25, and the inner surface of sleeve 29 closingly covers said swirl chamber 83 and aperture 81 obstructing the fluid flow path therethrough. Thus, whenever dispensing head 13 is in the close valving position on an aerosol dispenser, product dispensation is prevented eventhough the aerosol valve may be in a dispensing state.

To intentionally change from close to open discharge pposition, said pawl must first be depressibly disengaged from groovee 47 by applying gentle squeezing pressure against sides of the dispensing head, at pads 41A and 41B provided therefor.

In the following modifications of the invention, for the sake of understanding and brevity, each analogous element of the modified embodiment will be referred to with a number higher by 100 than was used in the preceding embodiment. Also, any difference in the function between analogous elements will be hereinafter specifically noted.

FIRST MODIFICATION

Figure 13:
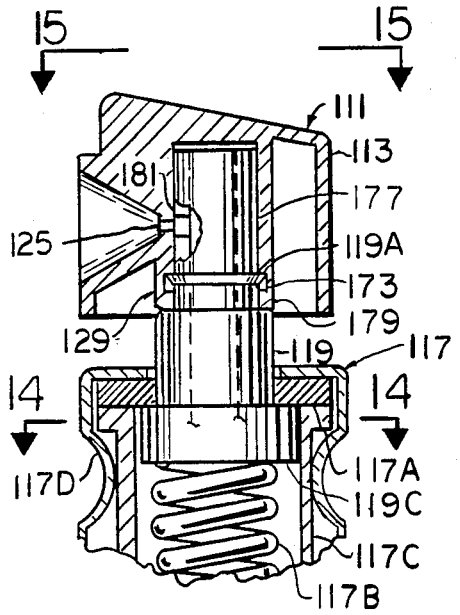
FIG. 13 is a cross sectional side view illustrating the first modification of the invention.

This modification, as shown in FIG. 13, relates to a simplified child resistant pushbutton actuator 111 that includes a dispensing head 113 cooperatively mounted on slightly modified primary valve 117. The dispensing head is rotatably mounted directly on a plunger, valve stem, 119 in sealing engagement and valving relationship therewith. The dispensing head and valve stem provide a secondary valving means whereby the dispensing head may be selectively rotated to an open valving position facilitating discharge of fluid product, or a close valving position that blockingly obstructs product discharge. And for the purpose of this modification, plunger 15, pawl 43, slits 45A and 45B, retaining lip 35, groove 37, and hexagonal shape 71 and 19B are not needed and have therefore been eliminated.

Valve stem 119 which projects upwardly from valve 117 is adapted to include shoulder 179, an upper diameter 177, annular retaining lip 119A, and at least one aperture 181 or swirl chamber (not shown) opening into the hollow interior of the stem. Upper diameter 177 is sized for slip fit sealing engagement within the hollow of dispensing head inner sleeve 129. Said sleeve hollow is additionally provided with an annular groove 173 for snap-fit assemblage with retaining lip 119A.

It can also be seen that aperture 181 is located to be fluid flow through alignment with discharge oriface 125 in a first, open, valving position that facilitates product discharge. And it should be evident that the dispensing head may be rotated to a second, close, valving position whereas the oriface and aperture are out of said alignment and the flow path between oriface 125 and aperture 181 is sealingly blocked by stem diameter 177 engagement within sleeve 129.

Figure 15:
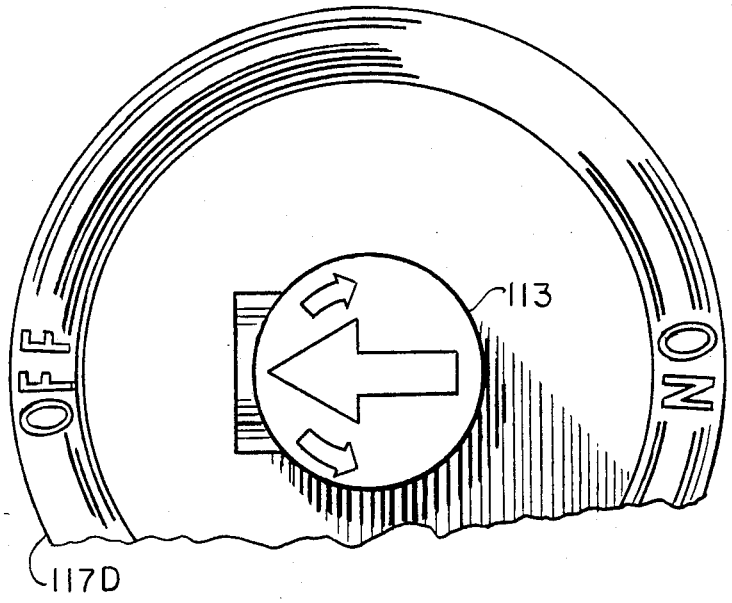
FIG. 15 is a plan view taken in the direction of line 15—15 of FIG. 13.
Figure 14:
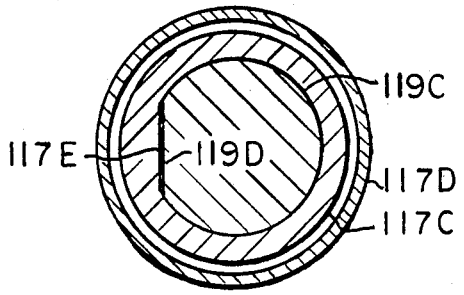
FIG. 14 is across sectional view taken along line 14—14 of FIG. 13 to illustrate features of the first modification primary valve.

To facilitate alignment of oriface 125 with aperture 181 the valve stem must be prevented from rotating so that the aperture will remain in a fixed radial position. This is easily accomplished, as seen in FIG. 14, by providing at least one flat side 119D on valve stem flange 119C and a corresponding flat interior wall 117E within body 117C. And appropriate indicia such as, OFF and ON, may be provided on valve cup 117D as seen in FIG. 15.

SECOND MODIFICATION

Figure 16:
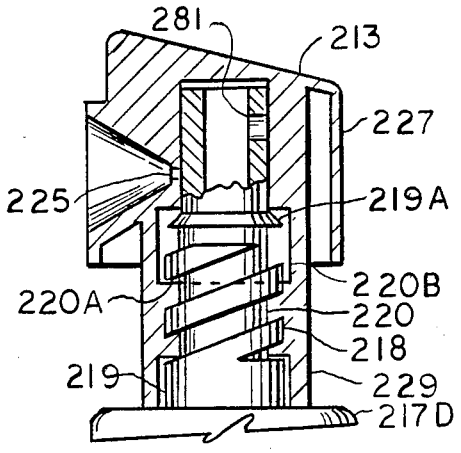
FIG. 16 and FIG. 17 are similar cross sectional side views of the second modification and depicting valving positions thereof.
Figure 17:
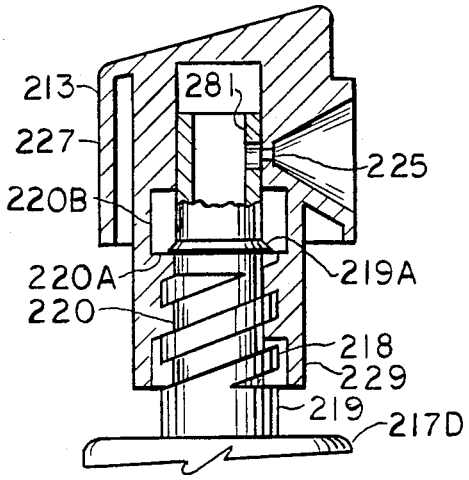

This modification seen in FIGS. 16 and 17 is basically an alteration of the foregoing modification where as, stem 219 is provided with a threaded portion 218 which is spaced approximately 0.09 inch above valve cup 217D and approximately 0.09 inch below retaining lip 219A, and the shoulder (179) has been eliminated. Also the flat side of the valve stem base and the corresponding valve body flatwall have been eliminated since in this modification it is preferred to have the primary valve serve as a torsional slip clutch. And the dispensing head is accordingly adapted to move axially when being rotated.

The dispensing head, with exception of the lower hollow portion of sleeve 229, is unchanged from the foregoing modification. The sleeve is extended in length and projects below the open end dispensing head 213 wall 227 sufficiently to be in contact with the top surface of the valve cup when the dispensing head in the close valving position, to block product discharge and prevent axial movement of the dispensing head, best seen in FIG. 16.

The hollow of the sleeve has threads 220 that correspond with and matingly engage stem threads 218. The upper end of threads 220 are cut flat to provide a semi-annular ledge 220A and upwardly therefrom there is an annular recess 220B wherein stem retaining lip 219A is situated. The recess is adapted to provide approximately 0.09 inch space between said retaining lip and ledge 220A when the dispensing head is in its lowermost location, in the close valving position. The recess is further adapted to provide an upper most limit for the dispensing head whereas oriface 225 is in fluid flow through alignment with aperture 281, thus, the open valving position. The uppermost limit is established by engagement, of ledge 220A against the lower surface of retaining lip 219, which is predetermined so as to assure said alignment of oriface 225 and aperture 281. Once the uppermost limit has been reached, overtravel is prevented by torsional slippage that occurs within the primary valve when greater resistance torsional resistance is produced by the uppermost limit engagement.

It should also be appreciated that upon rotation of the dispensing head travels along a path, about the valve stem, that corresponds with the pitch of the threads. Therefore, it is anticipated that various product discharge forms or combination thereof could easily be provided without departing from the spirit and scope of this modification.

THIRD MODIFICATION

Figure 18:
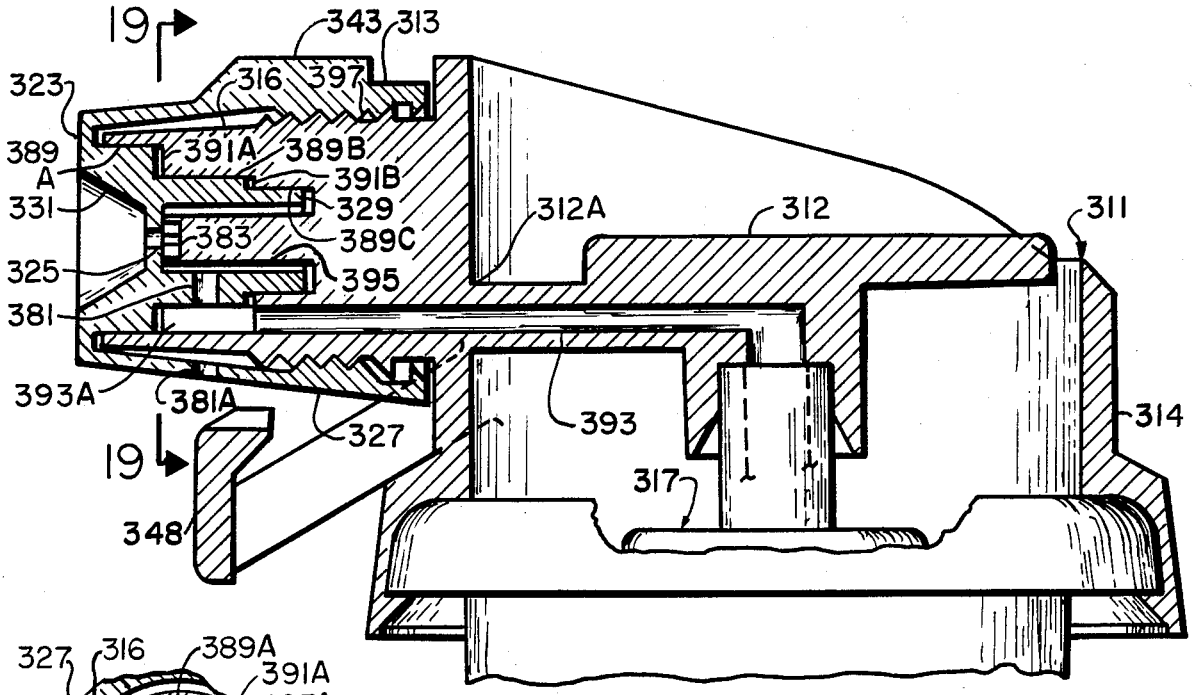
FIG. 18 is a cross sectional view of the third modification showing an alternative actuator.

This modification, as seen in FIG. 18, relates to a secondary valving actuator 311 which is adapted for operation of an aerosol type valve, primary valve 317, disposed on a container of product fluid (not shown). The actuator includes a substantially conventional foam applicator type pushbutton 312 adapted for mating engagement with said valve,, and flexibly joined to an upstanding annular collar 314 that is adapted to be securingly mounted on said valve.

In particular, this modification pertains to a nozzle, or dispensing head, 313 being mounted off to the side of said collar, and being adapted to provide secondary valving functions which are for use in addition with said primary valve functions. And whereby, said dispensing head may be selectively and valvingly rotated to an open, dispensing position, or alternatively rotated to a close position that obstructs discharge passage of fluid product eventhough said primary valve may be in an open valving position.

For further enhancement, said actuator also includes a reciprocatively depressible latch catch means 348 that is biased to engage and hold the dispensing head in the close valving position until said catch means is depressingly manipulated for disengagement.

On an outer side wall surface of collar 314, at the radial location designated 312A where said pushbutton is flexibly joined to the collar inner wall surface, there is an outwardly projecting snout 316 and over the end thereof said dispensing head is retainingly mounted and rotatable. Said snout and said dispensing head have a common axis that is perpendicular to the normal axis of an aerosol dispenser where on said primary valve may be mounted, and the projecting of said snout is indicative of the forward direction of said actuator.

The snout has at its forward end a concentric open mouth, closed bottom, stepped cavity bore having inwardly stepped successively smaller circular surfaces, respectively designated 389A, 389B, and 389C, and resulting annular shoulders 391A and 391B which are respectively located at the rearmost depths of cicular surfaces 389A and 389B.

There is an enclosed flow line, passageway, 393 that is adapted to be communicable with the interior of an aerosol product container (not shown), via an aerosol valve and said pushbutton including the collar joined flexible connection thereof for fluid product passage into the cavity bore.

Said passageway passes, below cavity bore portion defined by circular surface 389C, within the confinement of said snout and extends foward the length (depth) of circular surface 389B in the form of an inwardly open notch 393A which openly terminates at shoulder 391A.

Also contained within said cavity bore is a forwardly projecting nub 395 that depends from the rearmost surface of said cavity bore, and terminates providing flat terminus surface on a plane coinciding with shoulder 391A surface. Said nub may be utilized in an assortment of ways to provide a conventional mechanical breakup to effect a fine mist spray dispensation of fluids.

Figure 19:
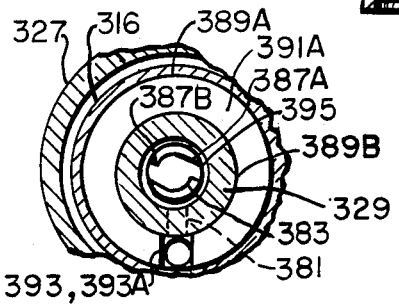
FIG. 19 is a cross sectional view, taken in the direction of line 19—19 of FIG. 18, to illustrate fluid breakup means.

However, in the present embodiment as seen in FIG. 19 a circular swirl recess 383 and a pair of grooves 387A, 387B are centrally located in the flat terminus surface of the nub to provide a means for said mechanical breakup. Said grooves are located on opposite sides of said swirl recess and they tangentially open into said recess, providing a channel across said nub terminus surface.

Nub 395 is shown having a circular cross sectional shape, but, other shapes are equally suitable. Said nub is concentrically located in said cavity bore and spaced from the circular surfaces 389B and 389C thereof providing an annular space between the sides of said nub and said circular surfaces.

Figure 20:
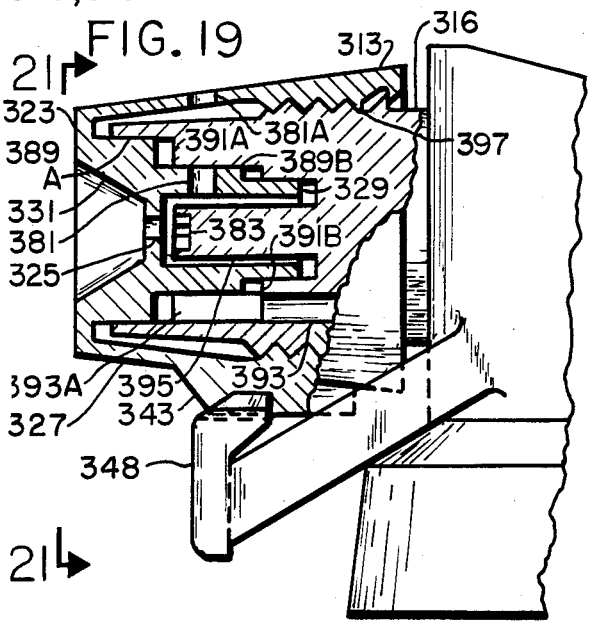
FIG. 20 is a partial side view similar to FIG. 18 provided to illustrate a positional change.

Dispensing head 313, as seen in FIG. 18 and FIG. 20, includes an outer cylindrical wall 327 having a rearward open end that is internally threaded and matingly engaged with corresponding external threads provided on the exterior of said snout at designation 397. The forward end of the dispensing head is substantially closed by an end wall 323 having an outer face conical shape centrally located depression 331, having a flat bottom wall overlying nub terminus, and therethrough an oriface 325 opening into recess 383. The threads allow dispensing head rotation, thus axial movement, to vary the distance from the nub to bottom wall to vary product discharge form from fine mist spray to stream.

Depending inwardly from the surface of end wall 323 is an inner cylindrical sleeve 329 having outer diameter surfaces that are snuggly and sealingly mated with cavity bore circular surfaces 389A, 389B and 389C. The sleeve outer diameter surfaces are sized and stepped to correspond with said cavity bore. And the sleeve inner diameter is sized to fit loosely around nub 395 to allow fluid flow therebetween.

Extending perpendicularly through a side wall of sleeve 329 is an aperture 381 that is suitably located to be in flow through alignment with passageway notch 393 as shown in FIG. 18, or selectively out of said alignment, whereat, said aperture is sealingly closed off by cavity bore circular surface 389B, as in FIG. 20.

In line with aperture 381 is a second aperture 381A that extends through wall 327. The purpose of said second aperture is merely to facilitate placement of aperture 381 in said inner sleeve wall.

As seen in FIGS. 18 and 20 there is formed on the outside surface of dispensing head cylindrical wall 327 an elongated latch key 343 that extends forward along said wall from the open end thereof. Said latch key is radially located corresponding with said valving positions, when said dispensing head is in the open valving position said latch key faces in an upwardly direction, see FIG. 18, and in the close valving position, said latch key faces straight down, see FIG. 20.

A depressible catch 348 that is flexibly hinged to, and extending from, collar 314 is provided to holdingly engage said latch key when said dispensing head is rotated to the close valving position. The catch must be in a depressed position whereby latch key is released before said dispensing head can be rotated from said close valving position. Said catch extends beneath said dispenisng head in a downwardly and forward slanting direction and it is reciprocatively biased to normally be in position for latching engagement with said latch key.

Figure 21:
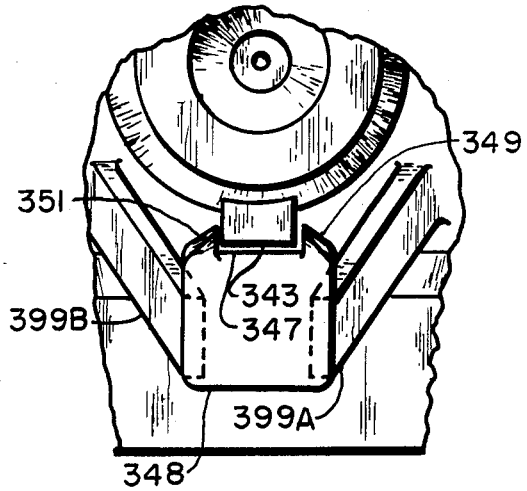
FIG. 21 is a view taken in the direction of line 21—21 of FIG. 20 illustrating latching features of the actuator.

It can further be seen in FIG. 21, that catch 348 is supported on opposite sides by a pair of flexible hinging arms 399A 399B which depend from collar 314. And said catch has formed in its upper surface a groove 347 between the crests of a pair of upwardly slanting surfaces 349 and 351 that function as cams which cooperate with latch key to drive said catch away, during latching, unitl the latch key is positioned between the crests. At that point said catch springs back into place capturing said latch key in groove 347. The catch is of a configuration suitable for manual manipulation.

It is thought that the invention and its advantages will be understood from the forgoing description and it will be apparent that various changes may be made in form, construction and arrangement of parts without departing from the spirit and scope of the invention or sacrificing all of its material advantages, the forms hereinbefore described being merely preferred embodiments thereof.

Having described my invention, reference should now be had to the following claims.

I claim:

1. A secondary valving actuator means for operation of a primary valve means disposed on a container of fluid product, which comprises:

a hollow plunger being adapted for captivative mounting on said primary valve means, and cooperative axial reciprocative and rotational movement therewith;

a dispensing head, having diametrically opposite side portions and a discharge oriface, being captivatingly mounted on said plunger and unitarily joined therewith, and valving and rotatably positionable relative thereto;

said dispensing head having valvingly cooperative with said plunger, turnable relative thereto and positionable to at least two valving positions, an open ON position that facilitates discharge of product through said oriface, and a close OFF position whereas said oriface is obstructed, preventing discharge passage of product therethrough;

said actuator being functionally responsive to grasping, in a pinching manner, and turning manipulation of the dispensing head and including at least one latch means having a reciprocatively movable latch member and a corresponding catch member being in latching engagment in said OFF position, whereas, said engagement prevents said dispensing head from being turned from said OFF position;

said side portions being adapted to accommodate said grasping and turning manipulation, and at least one of said side portions and said latch member being cooperative and movably responsive to said grasping for release of said latching engagement to facilitate turning of said dispensing head from said OFF position to said ON position, whereas, said latch means prevents turning of said dispensing head from said OFF position to said ON position prior to said grasping;

said grasping of said side portions in a pinching manner being required for disengagement of said latch member from said catch member.

2. In the invention of claim 1, said latch means being a pawl appendage of said dispensing head;

and said catch means being a vertical groove located in an inner wall surface of an upstanding collar that is joined to and encircles said plunger.

3. In the invention of claim 2, said collar having additionally located in said inner wall surface at least one detent for said pawl engagement therewith;

said detent being adapted to provide a sensing means to facilitate alignment of said dispensing head for product discharge.

4. In the invention of claim 1, said dispensing head and said plunger being captivatingly and unitarily joined.

5. In the invention of claim 1, said dispensing head being adapted to facilitate reciprocative movement of said latch means.

6. In the invention of claim 1, said hollow plunger having a closed upper end.

7. A secondary valving actuator means for operation of a primary valve means disposed on a container of fluid product, which comprises:

a hollow plunger being adapted for captivating mounting on said primary valve means, and cooperative axial reciprocative and rotational movement therewith;

a dispensing head being unitarily joined with and captivatingly mounted on said plunger, valvingly cooperative and positionable relative thereto to at least two valving positions, an open position that facilitates discharge of product through said oriface, and a close position whereas said oriface is obstructed, preventing discharge passage of product therethrough;

said actuator also having a reciprocatively movable latch means, and a corresponding catch means adapted to engagingly catch said latch means preventing relative rotational movement therebetween thereby preventing relative rotational movement between said dispensing head and said plunger;

said latch means being reciprocatively biased for snap-in-place engagement with said catch means whenever said dispensing head is rotated to said close valving position, and said latch means being depressibly disengagable from said catch means to facilitate valving rotation of said dispensing head from the close to open valving position;

said rotational positioning of the dispensing head, from the close position, being prevented from occurring prior to depressible disengagement of said latch means from said catch means;

said dispensing head having an upper wall and a substantially cylindrical outer wall having an open bottom, depending from said upper wall an inner cylindrical sleeve having an inner diameter surface and a lower open end, said discharge oriface into the interior of said sleeve;

said plunger having an aperture extending between the hollow of said plunger and an outer diameter surface thereof, said aperture providing means for fluid flow through communication between the hollow of said plunger and said oriface in a first valving position, said open position, for product discharge through said oriface;

said plunger outer diameter surface and said sleeve inner diameter surface blocking communication between the hollow of said plunger and said oriface with said oriface in a second valving position, said close position.

8. In the invention of claim 7, said plunger outer diameter surface having a depression forming a swirl chamber therein and located so as to be in fluid flow through alignment with said oriface in said first valving position of said dispensing head with respect to said plunger;

and said aperture, at least one, extending between the hollow of said plunger and said swirl chamber providing a communicating passageway therebetween and thereby establishing communication between the hollow of said plunger and said oriface, via said plunger and said swirl chamber, in the first valving position whereby product discharge through said oriface is in spray mist form.

9. In the invention of claim 3, said plunger having a second aperture extending between the hollow of said plunger and said outer diameter surface of said plunger, and said second aperture being at a second location, spaced from said swirl chamber, and located so as to be in flow through alignment with said oriface in a third valving position of said dispensing head relative to said plunger, thereby establishing communication between the hollow of said plunger and said oriface in an open, third valving position whereby product discharge through said oriface is in stream form.

10. In the invention of claim 7, said aperture being located so as to be in flow through alignment with said oriface in said first valving position whereby product discharge through said oriface is in stream form.

11. A secondary valving actuator means for operation of a primary valve means disposed on a container of fluid product, which comprises:

a hollow plunger, having an outer diameter surface, and a dispensing head adapted for product discharge therethrough;

the dispensing head being captivatingly mounted on said plunger for valving and rotational positioning relative thereto, and being mounted for axial movement therewith providing a means for reciprocative axial operation of said primary valve means;

said dispensing head having a cylindrical sleeve closed at one end and having an inner diameter surface snuggly engaging said plunger outer diameter surface in a sealing relationship;

said dispensing head also having a product discharge oriface opening into the interior of said sleeve;

said plunger having an aperture extending between the hollow of said plunger and said outer diameter surface, said aperture being the means for fluid flow communication between the hollow of said plunger and said oriface in a first valving, open, position for product discharge through said oriface;

said plunger outer diameter surface and said sleeve inner diameter surface blocking communication between the hollow of said plunger and said oriface in a second valving, close, position;

said plunger outer diameter surface having a depression forming a swirl chamber therein and located so as to be in fluid flow through alignment with said oriface in said first valving position of said dispensing head with respect to said plunger;

and said aperture, at least one, extending between the hollow of said plunger and said swirl chamber providing a communicating passageway therebetween and thereby establishing communication between the hollow of said plunger and said oriface, via said plunger and said swirl chamber, in the first valving position whereby product discharge through said oriface is in spray mist form.

12. In the invention of claim 11, said plunger having a second aperture extending between the hollow of said plunger and said outer diameter surface of said plunger, and said second aperture being at a second location, spaced from said swirl chamber, and located so as to be in flow through alignment with said oriface in a third valving position of said dispensing head relative to said plunger, thereby stablishing communication between the hollow of said plunger and said oriface in an open, third valving position whereby product discharge through said oriface is in stream form.

13. A secondary valving actuator means for operation of a primary valve means disposed on a container of fluid product, which comprises:

a hollow plunger, having an outer diameter surface, and a dispensing head adapted for product discharge therethrough;

the dispensing head being captivatingly mounted on said plunger for valving and rotational positioning relative thereto, and being mounted for axial movement therewith providing a means for reciprocative axial operation of said primary valve means;

said dispensing head having a cylindrical sleeve closed at one end and having an inner diameter surface snuggly engaging said plunger outer diameter surface in a sealing relationship;

said dispensing head also having a product discharge oriface opening into the interior of said sleeve;

said plunger having an aperture extending between the hollow of said plunger and said outer diameter surface, said aperture being the means for fluid flow communication between the hollow of said plunger and said oriface in a first valving, open, position for product discharge through said oriface;

said plunger outer diameter surface and said sleeve inner diameter surface blocking communication between the hollow of said plunger and said oriface in a second valving, close, position;

said plunger and said sleeve having corresponding threads in relative mating engagement, and said dispensing head being adapted to move axially upon rotation thereof;

said plunger and said sleeve also including means for limiting axial movement of said dispensing head, providing an uppermost limit and a lowermost limit;

whereas, said uppermost limit corresponds to an open dispensing position, and said lowermost limit corresponds to a close non-dispensing position.

14. A valving pushbutton actuator means for operation of a primary valve means disposed on a container of fluid product, which comprises:

a pushbutton nozzle mounted on a plunger means that is adapted to cooperatively couple said nozzle with the primary valve means for controllable discharge of product therethrough;

said nozzle and said plunger means being valvingly cooperative and turnably positionable, relative to each other, to and from an OFF position that blocks products discharge, thereby establishing a secondary valve means which is in addition to said primary valve means;

said nozzle having diametrically opposite side portions that are adapted to accommodate grasping, in a pinching manner, and turning manipulation;

and a latch means being adapteed to hold said secondary valve means in said OFF position and prevent turning therefrom;

said latch means and at least one of said side portions being cooperative and movably responsive to said grasping for release of said hold and thereby accommodate, subsequent thereto, turning said nozzle form the secondary valve OFF position, to facilitate product discharge.

15. A secondary valving actuator means for operation of an aerosol type primary valve means disposed on a container of fluid product, which comprises:

an upstanding collar, adapted to be securingly mounted on said primary valve means, having a flexibly joined pushbutton, and having a snout radially projecting outwardly therefrom;

said snout having an open mouth cavity located in the end thereof, and having located in said cavity an outwardly projecting nub that is adapted to accommodate discharge flow of fluid product thereabout;

said pushbutton being adapted for mating engagment with said primary valve means;

a passageway extending from said pushbutton and opening into said snout cavity so as to provide a fluid flow line for passage of fluid product from the primary valve means into said cavity;

a dispensing head having a substantially closed end wall, and being captivatingly mounted on said snout so as to be rotatable relative thereto and close said cavity;

said dispensing head being valvingly coopertive with said snout and selectively rotatably positionable to at least two valving positions, an open position that facilitates discharge of fluid product, and a close position whereas discharge of fluid product is blocked off;

said dispensing head also having an outer sleeve that substantially extends over and encircles said snout, an inner sleeve extending from said end wall into said cavity in snug sealing relative engagement therewith and loosely fitting around said nub providing fluid flow space therearound, and a discharge oriface that passes through said end wall and opens into the interior of the inner sleeve adjacent to said nub;

said inner sleeve having at least one aperture extending between the interior and exterior thereof and located so as to valvingly be in fluid flow through alignment with said passageway to facilitate discharge flow of fluid product through said oriface in said first valving position, in said second valving position said aperture is out of said alignment and sealingly blocked off by the relative engagment of the inner sleeve within said cavity.

16. In the invention of claim 15, said nub being adapted so as to provide a mechanical breakup means for fluid product discharge, whereby said fluid product is discharged in spray mist form.

17. In the invention of claim 16, said dispensing head being positionable along the axis of said snout whereas said end wall, and therefore discharge oriface, may be at various distances from said nub whereby fluid product may be discharged in forms varying from fine mist to stream.

18. In the invention of claim 15, said outer sleeve having an elongated latch key protruding from an outer surface thereof at a radial location corresponding to said valving positions;

said collar having a depending, reciprocatively depressible catch means that is adapted to holdingly engage said latch key whenever said dispensing head is rotated to said close position.

* * * * *